US006743116B2

(12) United States Patent
Wilbur

(10) Patent No.: US 6,743,116 B2
(45) Date of Patent: Jun. 1, 2004

(54) SEPARABLE-SHAFT GOLF CLUB

(76) Inventor: Kurt C. Wilbur, 1922 J.J. Pearce, Richardson, TX (US) 75081

( * ) Notice: Subject to any disclaimer, the term of this patent is extended or adjusted under 35 U.S.C. 154(b) by 0 days.

(21) Appl. No.: 10/224,921

(22) Filed: Aug. 20, 2002

(65) Prior Publication Data

US 2003/0050132 A1 Mar. 13, 2003

Related U.S. Application Data

(63) Continuation-in-part of application No. 09/654,993, filed on Sep. 5, 2000, now Pat. No. 6,447,404.

(51) Int. Cl.[7] ..... A63B 53/10
(52) U.S. Cl. ..... 473/296; 473/319
(58) Field of Search ..... 473/288, 296, 473/298, 299, 306, 307, 239, 292, 319; 74/548; 16/114 R; 81/177.2; 403/296

(56) References Cited

U.S. PATENT DOCUMENTS 1,565,069 A * 12/1925 Edwards ..... 473/298
2,463,053 A * 3/1949 Pritchard ..... 473/306
3,887,524 A 6/1975 Kirchner
4,253,666 A 3/1981 Murphy
4,340,227 A 7/1982 Dopkowski
4,856,782 A 8/1989 Cannan
5,184,825 A * 2/1993 Ruth ..... 473/228
5,390,921 A * 2/1995 De Ruyter ..... 473/299
5,413,338 A 5/1995 Kawamatsu
5,597,362 A 1/1997 Lee et al.
5,765,691 A 6/1998 Hall
5,792,006 A 8/1998 Hesser
5,857,923 A 1/1999 Veller
6,039,659 A 3/2000 Hamm

* cited by examiner

*Primary Examiner*—Stephen Blau
(74) *Attorney, Agent, or Firm*—Grady K. Bergen; Robert H. Johnson, III

(57) ABSTRACT

A golf club includes first and a second shaft members that are releasably connected by a connector that is preferably substantially hollow. The connector has a male connector that has a first portion and a second portion. The second portion is threaded on an exterior surface. The first portion of the male connector is coupled to one of the connecting ends of the shaft members. The connector also has a substantially hollow female connector that is coupled to the other shaft member. The threads on the exterior of the male connector are releaseably mated with interior threads on the female connector to provide an assembled golf club that may be disassembled for travel, but has characteristics that do not substantially vary from a similar conventional club. The mass of one connector is concentrated on its periphery.

15 Claims, 3 Drawing Sheets

SEPARABLE-SHAFT GOLF CLUB

RELATED PATENT APPLICATION

This application is a continuation-in-part of U.S. application Ser. No. 09/654,993, filed Sep. 5, 2000, entitled, "Separable-Shaft Golf Club," now U.S. Pat. No. 6,447,404.

TECHNICAL FIELD OF THE INVENTION

This invention relates generally to golf clubs, and more particularly, to a separable-shaft golf club.

BACKGROUND OF THE INVENTION

Practice is essential to developing a good and consistent golf game. Many golf enthusiasts enjoy practicing their game at the golf course, driving range, home, and on the road. When a golf player is traveling, he or she must either take his or her personal golf clubs or rent a set of clubs. Traveling with golf clubs, however, is difficult because they are long and cumbersome. When traveling by commercial airplane, they must be checked in the cargo section. While a golfer may only want a few clubs on the trip with which to practice, they are generally too long to fit within a suitcase or other travel bag for convenient transportation. Further, renting clubs is usually undesirable because of the expense and because the length, weight, and feel of the clubs may vary from the golfer's usual set. The differences may cause the practice session with rented clubs to do more harm than good. The club characteristics can be that important.

The overall weight, balance (or swing weight), flexibility, and the point of flexing of a golf club are all important characteristics to the golfer. The shaft is a major factor in determining all these characteristics. If one of these characteristics is substantially changed on a set of golf clubs, compared to a set that the golfer normally uses, it will interfere with his or her game.

Golf clubs designed for easy transportation have been proposed, but the clubs have not offered club characteristics sufficiently consistent with standard clubs. For example, U.S. Pat. No. 5,792,006 (Hesser) presents a collapsible, telescoping golf club shaft. Screws are used to hold the shaft in the assembled position and are removed to telescope the shaft for travel. As another example, U.S. Pat. No. 5,857,923 (Veller) discloses a golf putter that has a step removed in the middle of the putter. The putter shaft ends formed at the break where the step was removed are engaged by a solid screw that is placed in one end and a threaded sleeve in the other. Veller uses an overhanging lip at the resultant joint to provide stability to the assembled putter. Another example is found in U.S. Pat. No. 4,340,227 (Dopkowski), which apparently focuses on a variable length shank. Still another example is shown in U.S. Pat. No. 5,765,691 (Hall).

BRIEF SUMMARY OF THE INVENTION

Therefore, a need has arisen for a golf club that is easily transportable that addresses the shortcomings of the prior art. According to the present invention, a golf club includes a first hollow shaft member and second hollow shaft member that are releasably connected by a hollow connector. The hollow connector has a hollow male connector having a first portion and an externally-threaded second portion. The first portion of the male connector is coupled to one of the connecting ends of the shaft members. The hollow connector also has a hollow female connector with internal threads that is coupled to an interior portion of the other shaft member.

The threads on the exterior of the male connector are releasably mated with the interior threads on the female connector to provide an assembled golf club that may be disassembled for travel. This separable-shaft golf club has characteristics that are reasonably consistent with a standard golf club.

According to another aspect of the present invention, a method for making a separable-shaft golf club is provided that includes the following steps: providing a standard hollow steel golf club having a shaft; cutting the shaft of the standard golf club at approximately a middle point of the shaft to form a first shaft member and a second shaft member; coupling a hollow male connector to the first shaft member or the second shaft member so that threads of the second portion of the male connector extend from the first shaft member or second shaft member; coupling a hollow female connector, which has an interior threaded portion sized and configured to mate with the threads on the external portion of the male connector, to the other shaft member.

According to another aspect of the present invention, a graphite golf club has a length L and includes a first graphite shaft member having a first end and a second end; a second graphite shaft member having a first end and a second end; a club head coupled to the second end of the second shaft member; a substantially hollow male connector having a first portion and a second portion, the first portion coupled to an exterior portion of the second end of the first graphite shaft member or to an exterior portion of the first end of the second graphite shaft member, and the second portion of the substantially hollow male connector having external threads; a substantially hollow female connector having a hollow first portion and a hollow second portion, the second portion having a threaded interior, the first portion of the female connector coupled to the exterior portion of the first end of the second graphite shaft member or the exterior portion of the second end of the first graphite shaft member; wherein the external threads of the second portion of the substantially hollow male connector are sized and configured to mate with the threaded interior of the substantially hollow female connector to provide a releasable connection allowing the club to have an assembled configuration and a disassembled configuration; and wherein the center of gravity of the golf club in the assembled configuration is within plus or minus 15% of the club length L of the center of gravity of an otherwise identical club having a solid, integral shaft member.

BRIEF DESCRIPTION OF THE DRAWING

The accompanying drawing is incorporated into and forms a part of the specification to illustrate the preferred embodiment of the present invention. Various advantages and features of the invention will be understood from the following detailed description taken in connection with the appended claims and with reference to the attached drawing figures in which:

DETAILED DESCRIPTION OF THE INVENTION

The preferred embodiments of the present invention and its advantages are best understood by referring to FIGS. 1–5 of the drawings, like numerals being used for like and corresponding parts of the various drawings.

Figure 1:
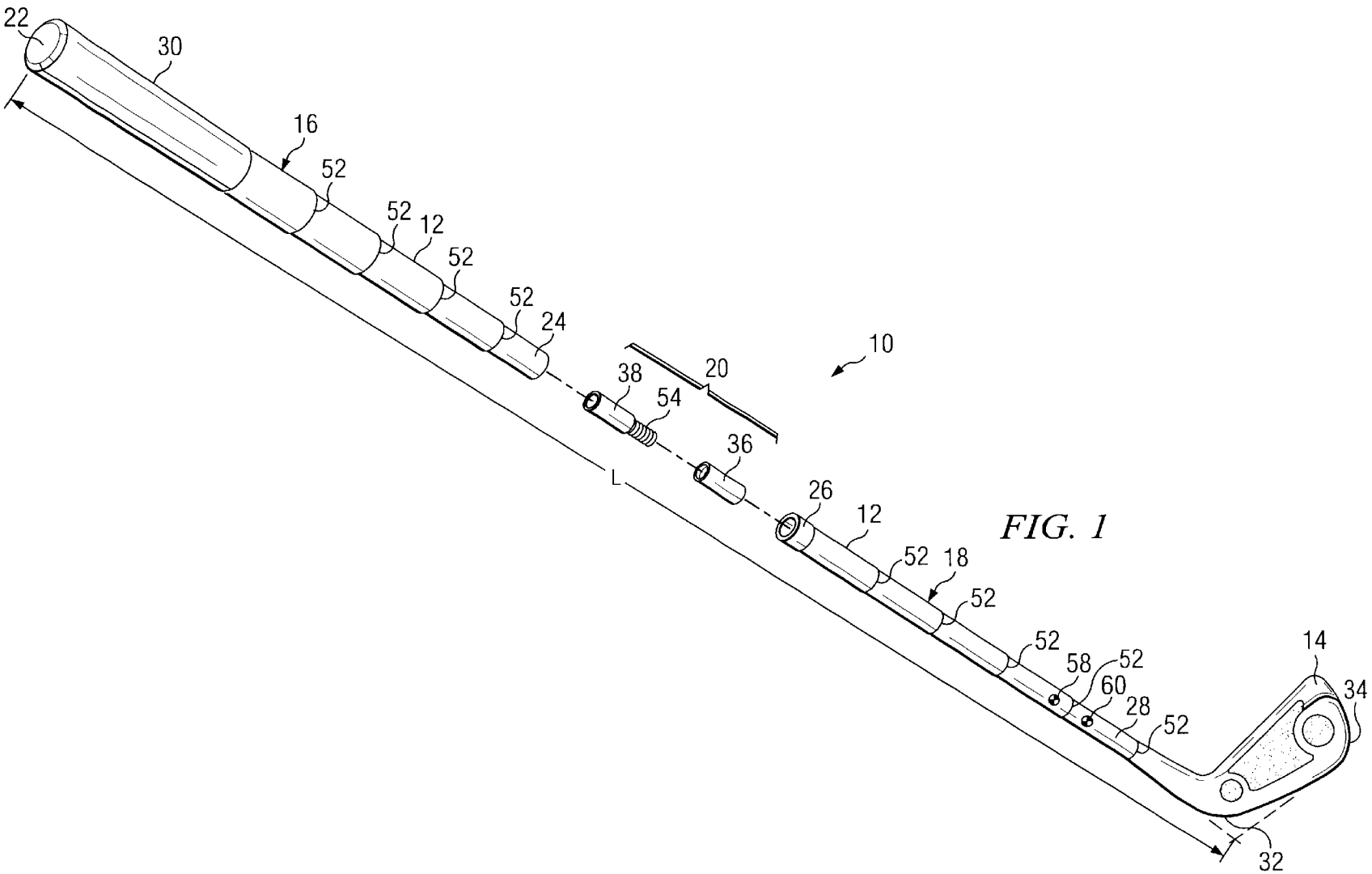
FIG. 1 is an exploded perspective view of a golf club with a separable shaft in accordance with the present invention.

Referring to FIG. 1, a separable-shaft golf club 10 includes shaft 12 and a club head 14. The shaft 12 has a first hollow shaft member 16 and a second hollow shaft member 18. The shaft members 16 and 18 are coupled by a releasable hollow connector, or connection, 20. The golf club 10 may thus be placed in an assembled configuration (see FIG. 4) or a disassembled configuration (see FIG. 3). The club 10 may be conveniently transported in the disassembled position, but has reasonable club characteristics when in the assembled position that do not vary substantially from a standard club.

The first shaft member 16, which is preferably a hollow steel shaft member, has a first gripping end or shaft butt end 22 and a second end or coupling end 24. The second shaft member 18 has a first end or coupling end 26 and a second end or club end 28. The first end 22 of the first hollow shaft member 16 is attached to a golf handle or grip 30. The second end 28 of second hollow shaft member 18 is attached to a golf club head 14. While an iron is presented for illustration purposes in the figures, the golf club 10 may also be a driver or a putter.

The golf club 10 has length L, which is measured from shaft end 22 to a reference point defined by the intersection of a line parallel with the heel 32 of the golf club head 14 and a line parallel to the shaft 12. The length, L, is typically in the range of 35 to 45 inches.

The first hollow shaft member 16 is joined to the second hollow shaft member 18 by a connection 20. The connection 20 has a hollow female connector 36 and a hollow male connector 38. The connection 20 that is formed by female connector 36 and hollow male connector 38 provides strength and stability to the assembled shaft 12 while maintaining light weight and balance. The connection 20 has a substantial amount of the material forming it on an outer perimeter thereby approximating a typical steel hollow shaft. This design is to provide strength and rigidity while remaining light-weight.

Figure 2:
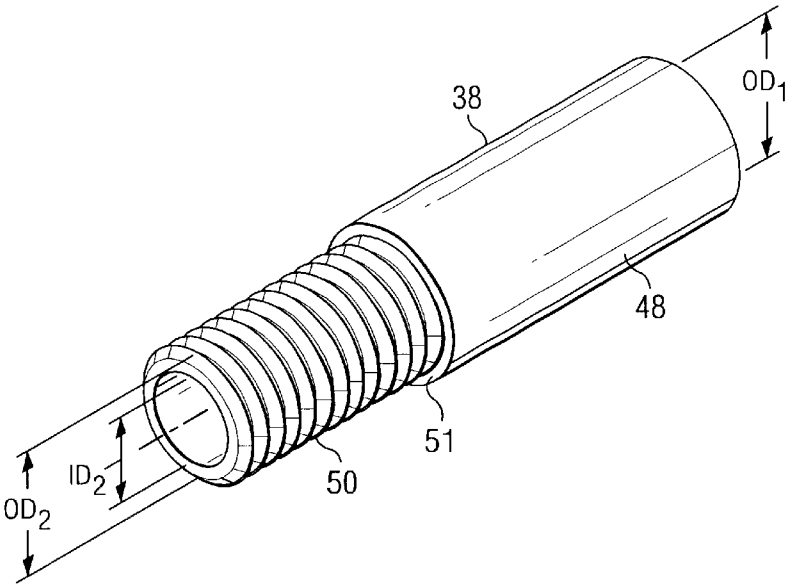
FIG. 2 is a perspective view of the hollow male connector and hollow female connector of the golf club of FIG. 1 in a disassembled configuration.
Figure 3:
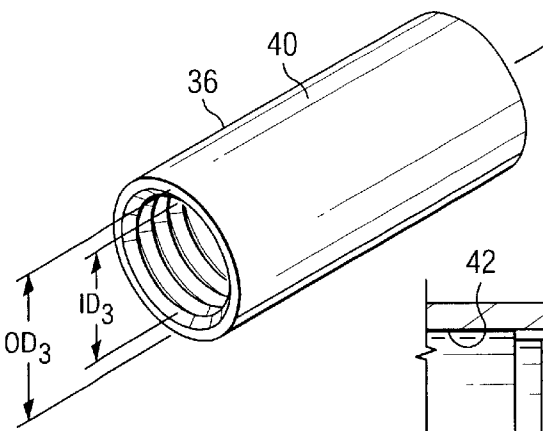
FIG. 3 is a cross sectional view in elevation of the hollow male connector and hollow female connector of the golf club of FIG. 1 in a disassembled configuration.
Figure 3:
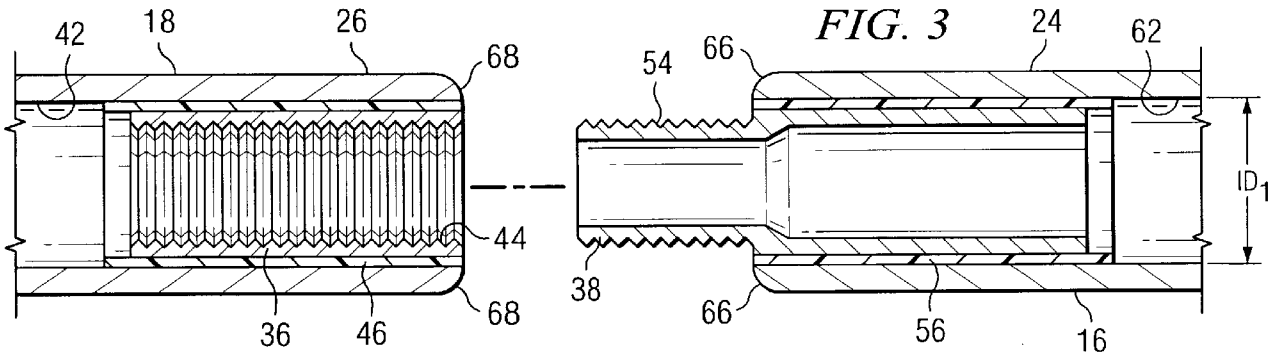
Figure 4:
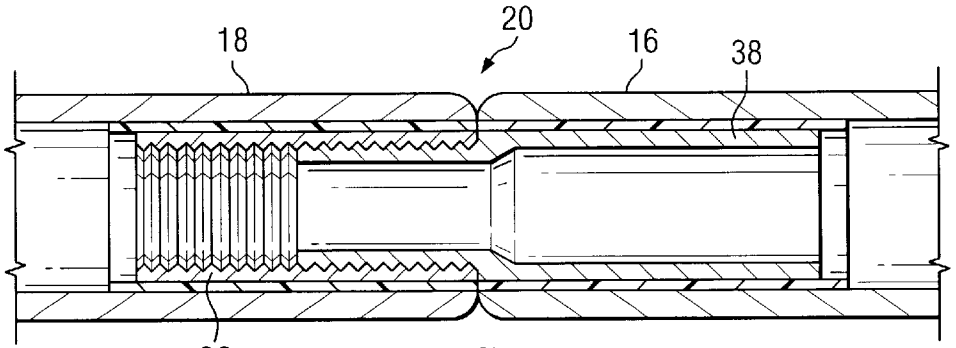
FIG. 4 is a cross sectional view in elevation of the hollow male connector and hollow female connector of the golf club of FIG. 1 in an assembled configuration.

Referring to FIGS. 1–4, and primarily to FIGS. 1 and 2, the hollow female connector 36 has an exterior surface 40 and an interior portion that includes internal threading 44. When installed, the hollow female connector 36 is recessed into the second hollow shaft member 18 substantially flush with the first end 26 of the shaft member 18. The hollow female connector 36 is secured by an adhesive or by spot welding or other connection technique to the interior 42 of the first end 26 of the second shaft member 18. Preferably, an epoxy adhesive 46 (shown in FIG. 4) is used to secure the hollow female connector 36 inside the shaft member 18. The female connector 36 has an inside diameter, $ID_4$, and an outside diameter, $OD_3$.

The hollow male connector 38 has a first portion 48 and a second portion 50. The first portion 48 has a first outside diameter, $OD_1$, and the second portion 50 has a second outside diameter $OD_2$. Preferably, the outside diameters have the following relationship: $OD_1 > OD_2$. Thus, a step 51 is formed between them. The smaller second portion 50 has external threads 54. To help keep the weight to a minimum, the male connector 38 is hollowed out. The first portion 48 is hollowed out to have an inside diameter, $ID_1$. The second portion 50 is also hollowed out to form a second inside diameter, $ID_2$. The hollow male connector 38 and the hollow female connector 36 are preferably made from steel, but other materials may be used. The hollow male connector 38 is partially inserted such that step 51 is substantially flush with the second end 24 of first shaft member 16. This leaves the external threading 54 exposed when in the disassembled configuration. The exterior of the first portion 48 of the hollow male connector 38 is secured to an interior portion of shaft 12 by an adhesive or by spot wielding. An epoxy deposit (see 56 in FIG. 4) is preferably used to secure the hollow male connector 38 to the interior of the shaft 12.

It is desirable to have connector 20 formed with as much of its material around an outer circumference as possible. $OD_1$ is preferably only slightly smaller than the interior diameter, $ID_3$, of the first shaft member 16 at the second end 24. It is preferable that the interior diameter $ID_1$ of the first portion 48 of male connector 38 be at least 70% of the interior diameter $ID_3$ of the shaft 12 at the second end 24 or first end 26. More preferably $ID_1$ will be at least 75% of $ID_3$ and more preferably yet will be 90% of $ID_3$. It is also desirable to have $ID_2$ be as big as possible. $ID_2$ is preferably at least 40% of $ID_3$, and more preferably at least 50% or greater of $ID_3$. Similarly, $ID_4$ is preferably at least 70% (and more preferably 90% or more) of the interior diameter of the shaft 12 where the female connector 36 is placed.

In the disassembled position, the shaft 12 is in two pieces 16 and 18 and can be readily transported. In the assembled position, a single shaft 12 is formed by connecting the shaft members 16 and 18 with the connection 20. In the assembled position, the partial external threading 54 of the hollow male connector 38 releasably engages the internal threading 44 of the hollow female connector 36 such that the second end 24 of first hollow shaft member 16 comes into contact or almost into contact with the first end 26 of second hollow shaft member 18. Preferably, all the threads on the hollow female connector 36 and hollow male connector 34 are "reverse threads" on a right-handed club head and "standard threads" on a left-handed club head. In this manner, the threaded connection between the second hollow shaft member 18 and first hollow shaft member 16 is urged tighter each time a golf ball is struck.

Referring again to FIG. 1, the female connector 36 and the male connector 38 are hollow to avoid placing unnecessary mass at the center of the club 10. The additional mass of the connector 20 should add as small of weight as possible when compared to the weight of an otherwise identical conventional club having a solid, integral shaft member and no connection member ("a similar conventional club"). This is particularly true since the connection 20 is formed in a middle portion of the club shaft 12. With this arrangement, the weight of the separable-shaft golf club 10 preferably varies less than 10% from a similar conventional club and more preferably varies less than 5%. Further, the center of gravity (C.G.) of the separable-shaft golf club 10 preferably varies less than 10% of club length L as compared to a similar conventional club, and more preferably varies less than 5%, and more preferably still varies less than 3%. The effect on the center of gravity (C.G.) is qualitatively shown in FIG. 1. The location of the C.G. of the club 10 with connector 20 is shown by reference numeral 58 and without the connector the location of the C.G. is shown by reference numeral 60. The C.G. is typically with in a few inches of a point that is 14 inches from the intersection of the line parallel to the bottom of the club head 34 and a line parallel to the shaft. In addition to remaining reasonably close in weight and balance, the club 10 also remains close on flexibility and point of flex. Thus, club 10 should feel normal to a golfer.

The golf club 10 may be created by retrofitting a conventional club or manufacturing it from scratch. When converting a conventional stepped cylindrical shaft having a length L to a separable-shaft embodiment, the shaft is severed with a pipe cutter, saw, or other cutting tool at a point approximately equal to ½ of L. If ½ L measures on a step of a conventional golf club, the cut is made in the middle of the step closer to the first end 22 of the first hollow shaft member 16. The cut divides the club into two portions, the first hollow shaft member 16 and the second hollow shaft member 18.

An interior portion 62 of the second end 24 of the first hollow shaft member 16 is abraded with a rasp or sand paper or other means. Similarly, an interior portion 42 of the first end 26 of the second hollow shaft member 18 is abraded. The coarse, uneven surface is more suitable for applying an adhesive. The second end 24 of the first hollow shaft member 16 may be rounded to form a rounded portion 66, and the first end 26 of the second hollow shaft member 18 may be slightly rounded off to form rounded portion 68. This may be accomplished with a rasp at the same time the abrading of the interior portions or by virtue of cutting with a pipe cutter or other means. The rounded ends allow the first end 26 to rest substantially if not completely flush with second end 24 when the connection 20 is in the fully assembled position. The outer surface of the hollow female connector 36 and the outer surface of the first portion 48 of the male connector are also preferably abraded. The hollow female connector 36 and the hollow male connector 38 are secured in each respective shaft member preferably by an epoxy contact adhesive 46 and 56. After curing the adhesives 46 and 56, the club 10 is ready for use. Of course, this is but one example of how to make club 10, and it is to be understood that numerous alterations are possible.

In one specific embodiment constructed and tested, the male connector 38 had an overall length of approximately 1.70 inches. The first portion 48 was approximately 1.0 inch long with an $OD_1$ of 0.43 inches. The second portion 50 was approximately 0.70 inches long with $OD_2$ of 0.372 inches with ⅜ inch threading on the exterior. The first portion of the male connector 38 was hollowed with an inside diameter, $ID_1$, of approximately ⅜ of an inch. The second portion 50 of the hollow male connector 38 had an interior diameter, $ID_2$, of 3/16 of an inch. The hollow female connector 36 was approximately 1.0 inches in length with an outside diameter, $OD_3$, of approximately 0.43 inches and an inside diameter, $ID_4$, of approximately ⅜ of an inch. The assembled connector 20 had a length of approximately 2.0 inches, which was sized to be approximately the length between two consecutive steps 52 on golf club 10. By not removing a step (between steps 52) from the shaft 12 but inserting the connector into the shaft, the shaft 10 stiffness is substantially maintained. In this illustrative embodiment, both the male connector 38 and the hollow female connector 36 were made from 12L14 steel, and the assembled connector 15 weighed approximately 14 grams and the entire club 10 weighed about 449 grams. Thus the connector made up about 3% of the club weight, and the separable-shaft golf club varied in weight by about 3.2% from the weight of a similar conventional club. The center of gravity was reflected in the club having a swing weight of D1 on the scale used by Golfsmith, Inc., Austin, Tex. It should be noted that the connector 20 may be made from other substances as well, e.g., graphite composites, hard plastics, or light metals such as titanium. If a graphite connector 20 is used, it may be desirable to further strengthen the connector 20 by making the male connector 38 solid, i.e., $ID_1=0$ and $ID_2=0$. Performance as mentioned above would, however, be maintained given the relative light weight of such materials.

Figure 5:
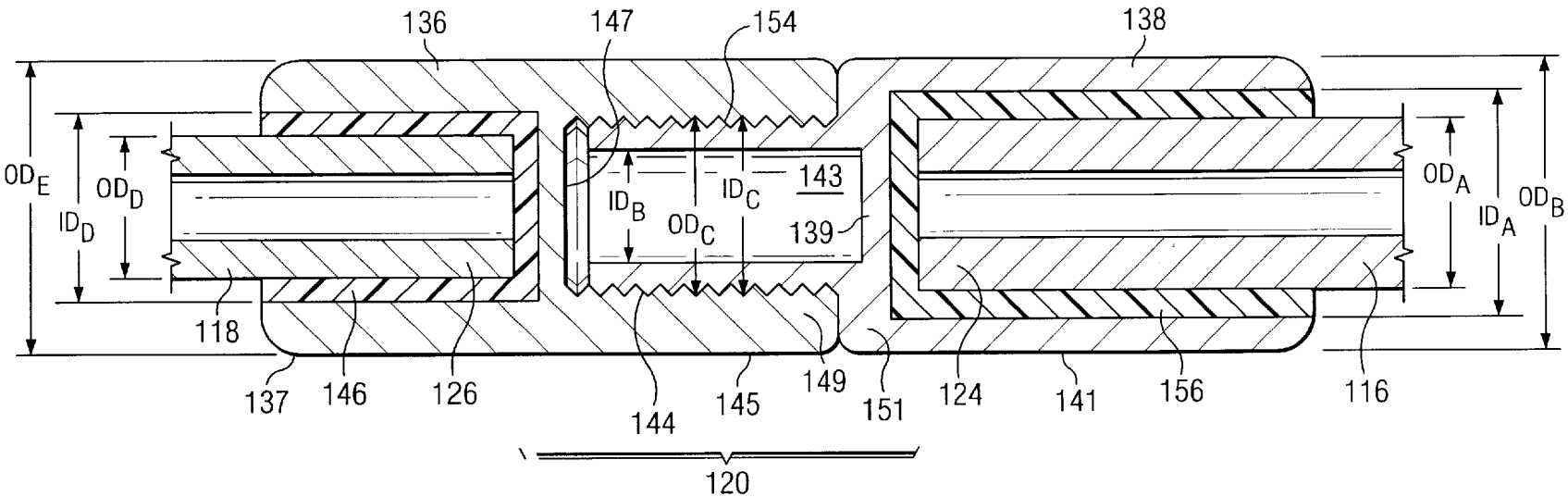
FIG. 5 is a cross sectional view in elevation of a male connector and female connector of a graphite golf club shown in the assembled configuration.

It may be desirable to use a connector on a golf club having a graphite shaft. In one embodiment, a hollow graphite shaft could be formed with a male connector on one member and a female connector formed on the other shaft member. As with the composite version of connector 20 discussed in the previous paragraph, it may be desirable in such a case to further strengthen the connection by making the connector solid. Alternatively, a separate connector may be used to connect two hollow graphite shaft members similar to that shown for steel shaft members in FIGS. 1–4. With reference to FIG. 5 such a connector 120 will be described. Connector 120 is used to releaseably couple two hollow graphite members 116 and 118 of a graphite shaft. The graphite golf club is substantially the same as the club of FIG. 1, except the shaft 12 of FIG. 1 is replaced by a graphite shaft not having steps. To accommodate the graphite shaft, the connector 120 is slightly different from connector 20.

Connector 120 has a female connector 136 and a male connector 138. Male connector 138 may be completely hollow or may have a web 139. The hollow aspects are defined by a first inside diameter $ID_A$ on a first portion 141 of male connector 138 and a second inside diameter $ID_B$ on a second portion 143. The first portion 141 has an outside diameter $OD_B$. In this embodiment, web 139 separates portion 141 and portion 143. End 124 of shaft member 116, which has an outside diameter $OD_A$, is inserted into the hollow opening of first portion 141, i.e., into the space defined by $ID_A$, and is secured therein with an adhesive 156, such as an epoxy. It follows that $ID_A>OD_A$. It will be apparent that web 139 provides an additional surface for the adhesive 156 to hold shaft member 116. The second portion 143 is formed with external threads 154 on an exterior of the second portion 143 of the male connector 138; this exterior portion has an outside diameter of $OD_C$.

The female connector 136 has a first portion 137 and a second portion 145. The first portion 137 has a hollow interior with an inside diameter of $ID_D$ that is sized and configured to receive end 126 of shaft member 118, which has an outside diameter of $OD_D$. In this embodiment, a web 147 is located between the first portion 137 and the second portion 145. End 126 of shaft member 118 is inserted into the hollow area defined by inside diameter $ID_D$ and is secured therein by an adhesive 146, such as an epoxy. Web 147 provides an additional surface with which adhesive 146 may hold member 118. Second portion 145 of the female connector 136 has a hollow area defined by an inside diameter $ID_C$. The internal side walls of this space have internal threads 144 that are sized and configured to mate with external threads 154 of the male connector 138.

Thus, with female connector 136 attached to shaft member 118 and with male connector 138 attached to shaft member 116 (or visa-versa), the members 116 and 118 may be releaseably coupled by placing the second portion 143 of male connector 138 into the second portion 145 of female connector 136 and securing the mated threads 144 and 154. Threads 144 and 154 are reverse threads for a right-handed player and standard for a left-handed player. This arrangement causes each impact of the club head with a ball to urge the threads 144 and 145 to more securely engage each other.

The shoulder 149 of female connector 136 and the shoulder 151 of male connector 138 may be formed to make a fitted abutment with substantially no space between them.

While webs 139 and 147 are included in the preferred embodiment to provide an additional gripping surface for the adhesive 146 and 156, the webs might be omitted to further lighten connector 120. The term "substantially hollow" is used to suggest that male and female connectors 136 and 138 may include or not include the webs 139, 147 but in any event, each has what has been described has two hollow sections or portions: 141 and 143 and 137 and 145.

As with the previous embodiment, connector 120 attempts to place as much of the mass of the connector as possible into an outer periphery of the connector. In this regard, preferably $ID_C<65\%\ OD_C$ and more preferably $ID_C<80\%\ OD_C$ and still more preferably $ID_C<90\%\ OD_C$. In addition, while steel is the easiest material for connector 120 to be made, other light weight materials such as titanium or aluminum might be used. The overall result of using connector 120 with a graphite shaft preferably allows the center of gravity of the graphite golf club in the assembled configuration to be within plus or minus 15% (or better) of the club length L of the center of gravity of an otherwise identical club having a solid, integral shaft member (i.e., the same club but not cut into two members and not having connector 120).

Although the present invention and its advantages have been described in detail, it should be understood that various changes, substitutions, and alterations can be made therein without departing from the spirit and scope of the invention as defined by the following claims. As another example, steps are shown on the shaft, but a step-less shaft design might be used as well. As yet another example, the male connection member 38 is shown attached to the first shaft member 16 and the female connector 36 is shown connected to the second shaft member 18, but it could be done the other way as well. Another example is that the hollow female connector 36 may be replaced by forming threads on the interior portion of first end 26 of second shaft member 18 so that the male connector would mate directly with it. Similarly, when manufacturing from scratch, the threaded portion 54 of male connector 38 might be formed directly on the second end 24 of first shaft member 16. In yet another example, webs 147 and 139 of FIG. 5 might have fasteners secured through them and into the shaft members 116 and 118 instead of or in addition to the adhesive. These are but a few examples of possible alternatives.

What is claimed is:

1. A golf club having a length, L, and a center of gravity comprising:

a first graphite shaft member having a first end and; second end;

a second graphite shaft member having a first end and a second end;

a club head coupled to the second end of the second shaft member;

a substantially hollow male connector having a first portion and a second portion, the first portion coupled to an exterior portion of the second end of the first graphite shaft member or to an exterior portion of the first end of the second graphite shaft member, and the second portion of the substantially hollow male connector having external treads;

a substantially hollow female connector having a hollow first portion and a hollow second portion, the second portion having a threaded interior, the first portion of the female connector coupled to the exterior portion of the first end of the second graphite shaft member or the exterior portion of the second end of the first graphite shaft member; wherein the external Threads of the second portion of the substantially hollow male connector are sized and configured to mate with the threaded interior of the substantially hollow female connector to provide a releasable connection allowing the club to have an assembled configuration and a disassembled configuration; wherein the center of gravity of the golf club in the assembled configuration is within plus or minus 15% of the club length L of the center of gravity of a club that is identical except having an un-severed, integral shaft member and having no hollow male connector and no hollow female connector; and wherein the second end of the first graphite shaft member and the first end of the second graphite shaft member have an outside diameter of $OD_1$ and wherein the first portion of the substantially hollow male connector has an interior diameter of $ID_1$, and wherein $ID_1>OD_1$ and wherein the first portion of the male connector has an outside diameter $OD_2$ and the second portion of the male connector has an inside diameter $ID_2$ and wherein $60\%\ OD_2<ID_2$.

2. The golf club of claim 1, wherein the male connector is coupled to the second end of the first shaft member by adhesive.

3. The golf club of claim 1, wherein the hollow female connector is coupled to the first end of the second shaft member by an adhesive.

4. The golf club of claim 1, wherein the female connector comprises an outboard shoulder and wherein the male connector comprises an outboard shoulder, and wherein the shoulder of the female connector and the shoulder of the male connector are rounded and sized and configured to abut each other in the assembled configuration of the club.

5. The golf club of claim 1, wherein the second end of first graphite shaft member and the first end of the second graphite shaft member have an outside diameter of $OD_1$ and wherein the first portion of the substantially hollow male connector has an interior diameter of $ID_1$, and wherein $ID_1>OD_1$ and wherein the first portion of the male connector has an outside diameter $OD_2$ and the second portion of the male connector has an inside diameter $ID_2$ and wherein $70\%\ OD_2<ID_2$.

6. The golf club of claim 1, a wherein the second end of first graphite shaft member and the first end of the second graphite shaft member have an outside diameter of $OD_1$ and wherein the first portion of the substantially hollow male connector has an interior diameter of $ID_1$, and wherein $ID_1>OD_1$ and wherein the first portion of the male connector has an outside diameter $OD_2$ and the second portion of the male connector has an inside diameter $ID_2$ and wherein $80\%\ OD_2<ID_2$.

7. The golf club of claim 1, wherein the second end of first shaft member and the first end of the second shaft member have an outer diameter of $OD_1$ and the second portion of the female connector has an outside diameter of $OD_5$ and wherein the first portion of the female connector has an interior diameter $ID_{10}$ and the second portion of the female connector has an interior diameter of $ID_{12}$, and wherein $ID_{10}>OD_1$ and $ID_{12}>60\%\ OD_5$.

8. The golf club of claim 1, wherein the second end of first shaft member and the first end of the second shaft member have an outer diameter of $OD_1$ and the second portion of the female connector has an outside diameter of $OD_5$ and wherein the first portion of the female connector has an interior diameter $ID_{10}$ and the second portion of the female connector has an interior diameter of $ID_{12}$ and wherein $ID_{10}>OD_1$ and $ID_{12}>70\%\ OD_5$.

9. A golf club having a length, L, and a center of gravity comprising:

a first graphite shaft member having a first end and a second end;

a second graphite shaft member having a first end awl a second end, a club bead coupled to the second end of the second shaft member;

a substantially hollow male connector having a first portion and a second portion, the first portion coupled to an exterior portion of the second end of the first graphite shaft member or to an exterior portion of the first end of the second graphite shaft member, and the second portion of the substantially hollow male connector having external threads;

a substantially hollow female connector having a hollow first portion and a hollow second portion, the second portion having a threaded interior, the first portion of the female connector coupled to the exterior portion of the first end of the second graphite shaft member or the exterior portion of the second end of the first graphite shaft member; wherein the external threads of the second portion of the substantially hollow male connector are sized and configured to mate with the threaded interior of the substantially hollow female connector to provide a releasable connection allowing the club to have an assembled configuration and a disassembled configuration; wherein the center of gravity of the golf club in the assembled configuration is within plus or minus 15% of the club length L of the center of gravity of a club that is identical except having an un-severed, integral shaft member and having no hollow male connector and no hollow female connector; and wherein the second end of first graphite shaft member and the first end of the second graphite shaft member have an outside diameter of $OD_1$;

the first portion of the substantially hollow male connector has an interior diameter of $ID_1$, and $ID_1>OD_1$;

the first portion of the male connector has an outside diameter $OD_2$;

the second portion of the male connector has an inside diameter $ID_2$ and wherein $80\%\ OD_2<ID_2$ the second portion of the female connector has an outside diameter of $OD_2$;

the first portion of the female connector has an interior diameter $ID_{10}$;

the second portion of the female connector has an interior diameter of $ID_{12}$; and the following constraints are met: $ID_{10}>OD_1$ and $ID_{12}>60\%\ OD_5$.

10. The golf club of claim 9, wherein the male connector is coupled to the second end of the first shaft member by adhesive.

11. The golf club of claim 9, wherein the hollow female connector is coupled to the first end of the second shaft member by an adhesive.

12. The golf club of claim 9, wherein the female connector comprises an outboard shoulder and wherein the male connector comprises an outboard shoulder, and wherein the shoulder of the female connector and the shoulder of the male connector are rounded and sized and configured to abut each other in the assembled configuration of the club.

13. The golf club of claim 9, wherein the second end of first shaft member and the first end of the second shaft member have an outer diameter of $OD_1$ and the second portion of the female connector has an outside diameter of $OD_5$ and wherein the first portion of the female connector has an interior diameter $ID_{10}$ and the second portion of the female connector has an interior diameter of $ID_{12}$, and wherein $ID_{10}>OD_1$ and $OD_{12}>70\%\ OD_5$.

14. The golf club of claim 9, wherein the second end of first shaft member and the first end of the second shaft member have an outer diameter of $OD_1$ and the second portion of the female connector has an outside diameter of $OD_5$ and wherein the first portion of the female connector has an interior diameter $ID_{10}$ and the second portion of the female connector has an interior diameter of $ID_{12}$, and wherein $ID_{10}>OD_1$ and $ID_{12}>80\%\ OD_5$.

15. A golf club having a length, L, and a center of gravity comprising:

a first graphite shaft member having a first end and a second end;

a second graphite shaft member having a first end and a second end;

a club head coupled to the second end of the second shaft member;

a substantially hollow male connector having a first portion and a second portion, the first portion coupled to an exterior portion of the second end of the first graphite shaft member or to an exterior portion of the first end of the second graphite shaft member, and the second portion of the substantially hollow male connector having external threads;

a substantially hollow female connector having a hollow first portion and a hollow second portion, the second portion having a threaded interior, the first portion of the female connector coupled to the exterior portion of the first end of the second graphite shaft member or the exterior portion of the second end of the first graphite shaft member; wherein the external threads of the second portion of the substantially hollow male connector are sized and configured to mate with the threaded interior of the substantially hollow female connector to provide a releasable connection allowing the club to have an assembled configuration and a disassembled configuration; wherein the center of gravity of the golf club in the assembled configuration is within plus or minus 15% of the club length L of the center of gravity of a club that is identical except having an un-severed, integral shaft member and having no hollow male connector and no hollow female connector; and wherein the second end of the first graphite shalt member and the first end of the second graphite shaft member have an outside diameter of $OD_1$ and wherein the first portion of the substantially hollow male connector has an interior diameter of $ID_1$, and wherein $ID_1>OD_1$ and wherein the first portion of the male connector has an outside diameter $OD_2$ and the second portion of the male connector has an inside diameter $ID_2$ and wherein $70\%\ OD_2<ID_2$.

* * * * *